US006615588B2

(12) United States Patent
Hoecker

(10) Patent No.: US 6,615,588 B2
(45) Date of Patent: Sep. 9, 2003

(54) ARRANGEMENT FOR USING A PLATE SHAPED ELEMENT WITH THROUGH-OPENINGS FOR COOLING A COMPONENT

(75) Inventor: Rainer Hoecker, Waldshut-Tiengen (DE)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 10/006,221

(22) Filed: Dec. 10, 2001

(65) Prior Publication Data

US 2002/0078691 A1 Jun. 27, 2002

(30) Foreign Application Priority Data

Dec. 22, 2000 (DE) ..... 100 64 264

(51) Int. Cl.[7] ..... F02C 1/00

(52) U.S. Cl. ..... 60/752; 60/760; 165/168; 165/174

(58) Field of Search ..... 60/752, 754, 760; 165/168, 169, 174, 908

(56) References Cited

U.S. PATENT DOCUMENTS

| | | | | |
|---|---|---|---|---|
| 3,046,742 A | * | 7/1962 | Egbert et al. | 60/39.65 |
| 3,169,367 A | * | 2/1965 | Hussey | 60/39.37 |
| 3,391,535 A | * | 7/1968 | Benjamin | 60/39.74 |
| 4,339,925 A | | 7/1982 | Eggmann et al. | |
| 4,621,995 A | * | 11/1986 | Wersosky | 425/144 |
| 4,719,748 A | * | 1/1988 | Davis, Jr. et al. | 60/39.37 |
| 5,316,075 A | * | 5/1994 | Quon et al. | 165/80.4 |
| 5,363,653 A | * | 11/1994 | Zimmermann et al. | 60/751 |
| 5,388,412 A | | 2/1995 | Schulte-Werning et al. | |
| 5,488,825 A | * | 2/1996 | Davis et al. | 60/39.75 |
| 5,784,876 A | | 7/1998 | Alkabie | |
| 5,960,632 A | * | 10/1999 | Abuaf et al. | 60/752 |
| 6,021,570 A | | 2/2000 | Lockyer et al. | |

FOREIGN PATENT DOCUMENTS

| | | |
|---|---|---|
| DE | 3815382 A1 | 11/1988 |
| DE | 2836539 C2 | 5/1990 |
| DE | 3815382 C2 | 2/2000 |
| DE | 3842470 C2 | 2/2000 |
| EP | 0 203 431 | 12/1986 |
| EP | 0 239 020 | 9/1987 |
| EP | 0239020 A2 * | 9/1987 |

* cited by examiner

*Primary Examiner*—Charles G. Freay
*Assistant Examiner*—John F. Belena
(74) *Attorney, Agent, or Firm*—Burns, Doane, Swecker & Mathis, L.L.P.

(57) ABSTRACT

The present invention relates to an arrangement for the cooling of a component, in particular of the combustion chamber of a turbo machine, wherein at least one cooling duct (5) is provided between a wall (1) to be cooled and a plate-shaped element (2) spaced apart from the wall. The plate-shaped element (2) has a number of through openings (4) for a cooling medium and is arranged such that the distance to the wall (1) increases in the flow direction of the cooling medium through the cooling channel (5). The arrangement is characterised in that the size of the through openings (4) in the plate-shaped element (2) increases with increasing distance between the plate-shaped element (2) and the wall (1). In this way a homogeneous cooling over the length of the cooling channel is achieved with simple measures.

20 Claims, 2 Drawing Sheets

ARRANGEMENT FOR USING A PLATE SHAPED ELEMENT WITH THROUGH-OPENINGS FOR COOLING A COMPONENT

FIELD OF THE INVENTION

The present invention relates to an arrangement for cooling a component, in particular for cooling the combustion chamber of a turbomachine, in which at least one cooling duct is configured between a component wall to be cooled and a plate-shaped element at a distance from the wall, the plate-shaped element having a number of through-openings for a cooling medium and the distance between the plate-shaped element and the wall increasing in the flow direction of a cooling medium flowing through the cooling duct and impinging by means of the through-openings onto the wall.

The present cooling arrangement is particularly suitable for use in cooling a gas turbine combustion chamber, in which the cooling ducts are configured between the plate-shaped element and the combustion chamber wall.

BACKGROUND OF THE INVENTION

The wall segments of combustion chambers are exposed to very high temperatures. A sufficiently long life of the combustion chamber wall can only be ensured if this wall is additionally cooled during operation. In known combustion chamber arrangements in gas turbine installations, the combustion chamber wall has a double-walled embodiment so that a cooling medium can be inserted into the cooling duct formed by the intermediate space. In this connection and particularly in the case of gas turbine installations, it is known art to guide the combustion air compressed by the compressor through this gap or cooling duct along the combustion chamber wall before it is mixed with the fuel and introduced into the combustion chamber.

An example of a gas turbine combustion chamber configured in this way may be derived from U.S. Pat. No. 4,339,925. In this combustion chamber arrangement, the cooling duct is configured by means of the intermediate space between a plate-shaped element and the combustion chamber wall, the plate-shaped element in the form of a perforated plate being matched to the outer contour of the combustion chamber in such a way that a cooling duct of constant height is formed by means of a constant distance between the plate-shaped element and the combustion chamber wall. The cooling air penetrates by means of the through-openings provided in the plate-shaped element into the cooling duct and, in the process, meets the combustion chamber wall approximately at right angles. A particularly effective cooling effect is achieved by such impingement cooling.

In the case of a compact construction of the combustion chamber, the cooling air flows along the combustion chamber wall in the direction opposite to that of the hot gases generated in the combustion chamber after the combustion process (counterflow principle). In general, the whole of the mass flow of the air intended for the combustion is available for cooling the combustion chamber wall. The pressure loss along the cooling duct is predetermined by the pressure loss of the burners, i.e. by the pressure loss during the mixing of the fuel and air. For cooling purposes, an attempt is therefore made to make the best possible use of this given pressure difference between the outlet from the compressor and the combustion chamber in the cooling of the combustion chamber wall.

The impingement cooling technique is suitable for cooling of the combustion chamber wall in a particularly efficient manner. Precisely in the case of the employment of such a cooling technique for combustion chambers, however, there are some limitations which impair the efficiency of the impingement cooling. In this connection, an essential limitation is caused by the limited space relationships on the cooling air side at the interface between the combustion chamber and the turbine which abuts it. These limited space relationships require a reduction in the distance between the plate-shaped element (usually configured as a perforated plate) and the combustion chamber wall to be cooled in the direction toward the turbine stage and therefore lead to a reduction in the cooling duct height in this region.

In order to improve the efficiency of the cooling, impingement cooling geometries were described and investigated in L. W. Florschuetz et al., "Streamwise Flow and Heat Transfer Distributions for Jet Array Impingement with Crossflow", ASME, 81-GT-77, pages 1–10, in order to evaluate their influence on the cooling efficiency. In this work, different ratios of the distances apart of the through-openings in the perforated plate to the diameter of these through-openings and the different ratios of the cooling duct height to the diameter of these through-openings were selected. In all the variants investigated in this work, the diameter of the through-openings and the cooling duct height were constant over the length of the cooling duct.

In the case of these impingement cooling geometries, it is known that the cooling effect decreases in the direction in which the air flows away over the cooling duct. Tests have now shown that this behavior is not observed in the case of a geometry in which the duct height increases in the flow direction of the cooling duct. The reason for this is the pressure distribution along the cooling duct. The pressure difference across the perforated plate increases in the direction in which the air flows away. This has the result that the major part of the cooling air flows through the rear holes—in the direction of the air flowing away—and, in the process, cools particularly well. This, however, again leads to a non-uniform cooling effect over the length of the cooling duct.

A combustion chamber arrangement for solving this problem is described in U.S. Pat. No. 5,388,412. In this, the distance between the plate-shaped element and the combustion chamber wall to be cooled likewise increases in the flow direction of the cooling duct formed. In order to avoid the non-uniform cooling effect, the through-openings are provided with tube-like protrusion elements in this arrangement. These protrusion elements extend at right angles to the combustion chamber wall in the cooling duct and their outlet ends have the same distance from the combustion chamber wall over the whole length of the cooling duct. A more uniform cooling effect can be achieved in this way over the length of the cooling ducts. In this arrangement, it is likewise proposed to appropriately modify the diameters of the through-openings at certain locations on the cooling duct in order to intensify the cooling at these locations.

SUMMARY OF THE INVENTION

The object of the present invention consists in providing an arrangement for cooling a component, in particular the combustion chamber of a gas turbine, which arrangement can be realized in a simple manner and has a uniform cooling performance over the length of the cooling duct.

The object is achieved by means of the arrangement according to claim 1. Advantageous embodiments of the arrangement are the subject matter of the sub-claims. In the case of the present arrangement for cooling a component, at least one cooling duct is configured between a component wall to be cooled and a plate-shaped element at a distance from the wall. In this arrangement, the plate-shaped element has a number of through-openings for a cooling medium and its shape is matched to the contours of the wall to be cooled. This plate-shaped element, also designated below as perforated plate in accordance with its preferred configuration, is arranged opposite to the wall to be cooled or is fastened to the latter in such a way that the distance between the plate-shaped element and the wall increases in the flow direction of a cooling medium flowing through the cooling duct and impinging by means of the through-openings onto the wall. In a gas turbine combustion chamber cooled on the counterflow principle, the cooling duct height, which is determined by the distance between the plate-shaped element and the wall, therefore decreases in the direction toward the turbine stage. The present arrangement is therefore characterized by the size of the through-openings in the plate-shaped element increasing with increasing distance between the plate-shaped element and the wall. In this arrangement, the distribution of the through-openings along the cooling duct is not, initially, of importance. These through-openings are, however, preferably arranged in a plurality of rows which extend parallel to the flow direction.

A uniform cooling along the cooling duct is achieved by means of the increasing size of the through-openings in the plate-shaped element in the flow direction without, for example, additional tubular protrusion elements having to be provided for this purpose on the through-openings. Although the specialist, in the case of the present problems of the cooling duct height increasing in the flow direction (and the associated increased cooling of the regions located downstream) might consider a reduction of the through-openings in these regions in order, by means of this measure, to provide compensation for the uneven cooling distribution, precisely the opposite way is chosen in the present invention. In this connection, the inventors have recognized that the present solution leads, surprisingly, to the desired result whereas the more obvious way results in precisely the opposite effect and, in particular, reduces the effectiveness of the impingement cooling.

The diameter of the through-openings is preferably proportional to the distance traversed along the cooling duct at the respective position of the through-openings. The distance traversed should be here under-stood as the length of the cooling duct—viewed in the flow direction—which the duct has attained at the position of the respective through-opening. The through-openings which are arranged at twice the distance traversed along the cooling duct have also, therefore, twice the diameter. A very uniform cooling distribution can be achieved by means of this embodiment.

The present invention can, of course, be operated with different cooling media, i.e. different gases, such as air for example, or liquids. The cooling medium leaves the cooling geometry essentially in a direction, the flow direction of the cooling duct, also designated below as the transverse flow direction. The duct, through which the cooling medium flows away, can optionally have an additional inlet through which the initially transverse flow in the duct can enter. The wall, which has to be cooled and which is opposite to the perforated plate, is designated the impingement plate. The through-openings, or holes in the perforated plate, are arranged in the manner given above so that their diameter increases in the transverse flow direction, the hole diameter being preferably proportional to the distance traversed along the duct. The present arrangement obviates the disadvantages present in the prior art because the geometric parameters of the hole arrangement are displaced into a numerical range which has particularly good cooling effectiveness. The ratio between the duct height and the hole diameter is preferably greater than 1 in this case and/or the ratio of the distance apart of the holes—in the flow direction to the hole diameter is selected to be greater than 1.5. The distance apart of the holes should here be understood as the center to center distance of the holes. The pressure and mass flow distribution in the cooling duct, which arises with such a configuration, leads to a very uniform heat transfer distribution over the length of the cooling duct. The heat transfer on the wall to be cooled is therefore almost independent of the position in the duct, i.e. independent of the hole position in the transverse flow direction.

In this case, an in-line arrangement of the holes parallel to the flow direction, in which the individual holes of the different rows are respectively located at the same level, leads to better values than an arrangement with offset holes.

In the present arrangement, the ratio of the distance between the plate-shaped element and the wall to the diameter of the through-openings is preferably constant over the complete length of the cooling duct. In addition, the ratio of the distance between the plate-shaped element and the wall to the diameter of the through-openings is likewise preferably constant over the length of the cooling duct.

It is obvious that the geometry of the through-openings does not necessarily have to be circular. Although, furthermore, the present arrangement is particularly suitable for cooling the combustion chamber of a gas turbine, it can be applied without difficulty to other components which have to be cooled. In this case, the plate-shaped element is arranged in a similar manner to form a cooling duct with a distance which increases in the flow direction. This plate-shaped element can, in this case, be directly connected to the wall to be cooled or can be fixed relative to this wall by means of a special carrier. Struts extending in the flow direction can likewise be provided on the wall to be cooled or on the plate-shaped element in order to configure a plurality of cooling ducts located adjacent to one another.

BRIEF DESCRIPTION OF THE DRAWINGS

The present invention is again briefly explained below using embodiment examples, in association with the drawings, without limitation to the general concept of the invention.

In the drawings.

DETAILED DESCRIPTION OF THE INVENTION

Figure 1:
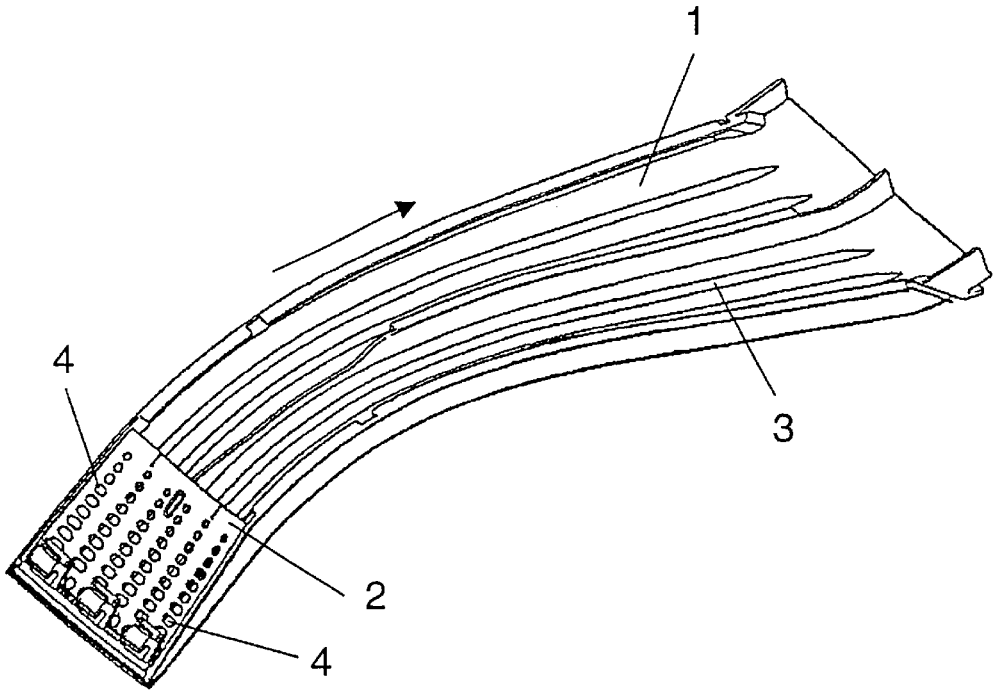
FIG. 1 shows a segment of a gas turbine combustion chamber wall.

FIG. 1 shows a segment of a gas turbine combustion chamber wall 1, such as is known for example from the prior art cited at the beginning. The arrangement of a gas turbine combustion chamber composed of such segments is known to the specialist. For more precise details, reference is, for example, made to the publications cited in the introduction to the description. Provision is made on the outside of this combustion chamber wall 1 for struts 3 which, in association with the plate-shaped element 2 placed on them, permit the occurrence of a plurality of cooling ducts located adjacent to one another. In the present example, a cooling arrangement is shown on the lower left-hand side of the impingement region, in which cooling arrangement the perforated plate 2 is arranged at a distance from the combustion chamber wall 1 and this distance increases in the flow direction, indicated by the arrow. In such an arrangement, the turbine stage abuts on the left-hand side of the combustion chamber and the compression stage abuts on the right-hand side. A distribution of the through-openings 4 in the perforated plate 2, such as a specialist might possibly consider in order to avoid an increased cooling of the downstream regions under the perforated plate 2, is indicated in the figure. In this example, the size of the through-openings 4 therefore decreases in the flow direction.

As already mentioned previously, however, particularly efficient impingement cooling is not achieved with such an arrangement.

Figure 2:
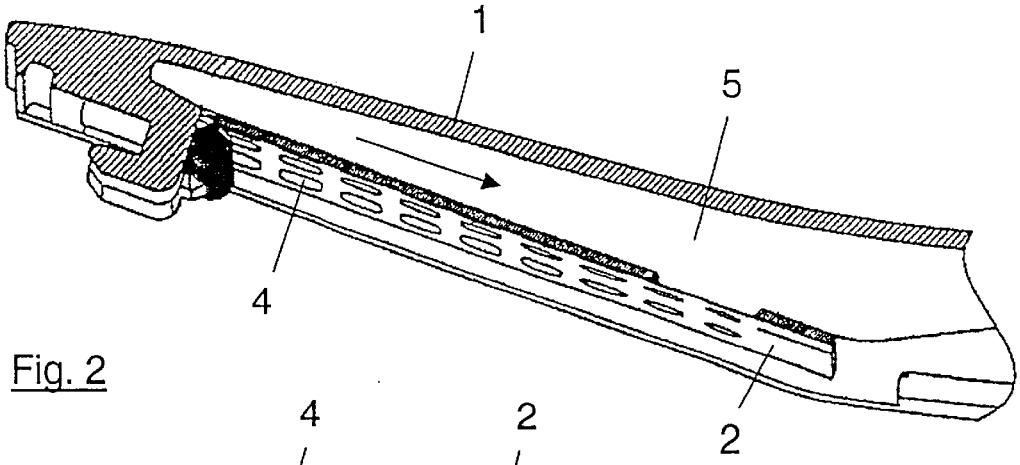
FIG. 2 shows a transverse sectional view of an excerpt, which represents the impingement cooling region, from the segment of FIG. 1.

FIG. 2 again shows, in transverse cross section, the impingement region which can be recognized on the left-hand side of FIG. 1. The cooling duct 5 is formed by the distance present between the perforated plate 2 and the combustion chamber wall 1. The air compressed by the compression stage of the gas turbine enters the cooling duct 5 via the through-openings 4 and there meets the combustion chamber wall I approximately at right angles in order to effect the desired impingement cooling. A coolant flow forms in the cooling duct 5 in the direction of the increasing cooling duct height, as is indicated by the arrow.

As already mentioned, the distribution selected in this example for the sizes of the through-openings, which decreases in the flow direction, does not lead to satisfactory cooling results.

Figure 3:
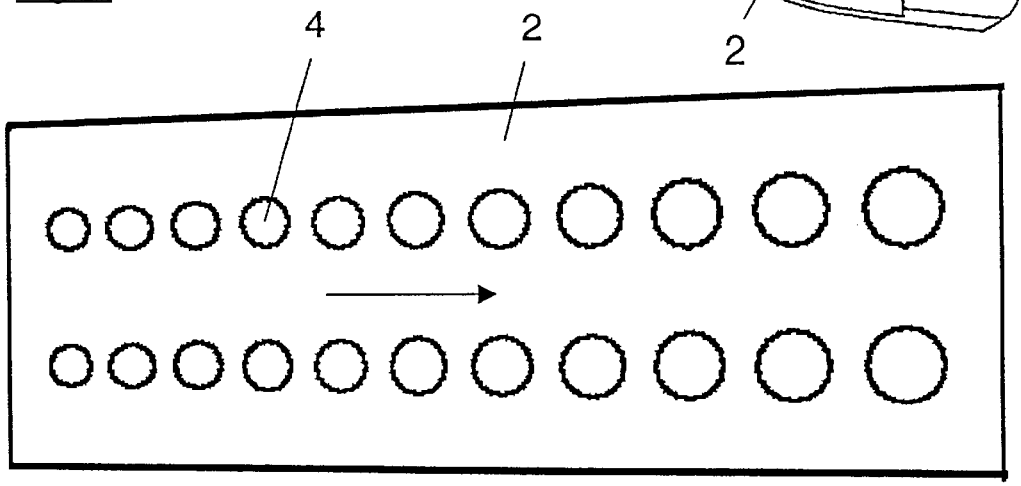
FIG. 3 shows a perforated plate according to the present invention with diameter increasing in the transverse flow direction and in-line arrangement of the holes.

FIG. 3 shows, finally, a perforated plate 2 with a distribution of the size of the through-openings 4 such as is realized in the case of the present invention. Such a perforated plate is introduced instead of the perforated plate of FIG. 2 in the arrangement present there.

The opening of the through-openings 4 which increases in the flow direction in proportion to the respective distance traversed of the cooling duct 5 may be very easily recognized in this example. The flow direction is again indicated by the arrow. The in-line arrangement of the through-openings 4 present here, in which the openings of each row are at the same level, leads to particularly advantageous results. In this arrangement, the increasing distance in the flow direction between the through-openings with increasing size of the latter can also be recognized.

Figure 4:
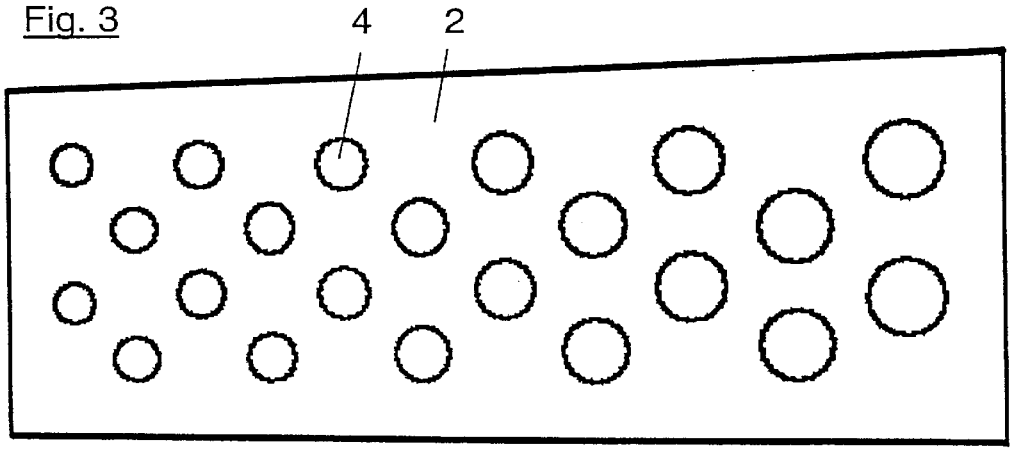
FIG. 4 shows a perforated plate according to the present invention with diameter increasing in the flow direction and offset arrangement of the holes.

FIG. 4, finally, shows a further example of a perforated plate such as can be employed in the appliance according to the invention. In contrast to the arrangement of FIG. 3, the individual through-openings 4 of the various rows are here arranged offset relative to one another. The diameter of the through-openings again increases continuously in the flow direction.

List of designations

1 Combustion chamber wall

2 Perforated plate

3 Struts

4 Through-openings

5 Cooling duct

What is claimed is:

1. An arrangement for cooling a component, comprising:

at least one cooling duct configured between a wall to be cooled and a plate-shaped element for flow of a cooling medium in a flow direction along the wall to be cooled, the plate-shaped element being at a height from the wall and having a number of through-openings for impingement of flow of the cooling medium onto the wall, the height between the plate-shaped element and the wall increasing in the flow direction of the cooling medium flowing through the cooling duct, wherein diameters of adjacent through-openings in the plate-shaped element increase with increasing height between the plate-shaped element and the wall and each of the diameters of the through-openings is equally proportional to a length measured in the flow direction from the beginning of the cooling duct to a respective position of the through-openings on the cooling duct .

2. The arrangement as claimed in claim 1, wherein a ratio of a distance between adjacent through-openings to the diameter of one of the adjacent through-openings is constant over the length of the cooling duct.

3. The arrangement as claimed in claim 1, wherein a ratio of the height between the plate-shaped element and the wall at one of the through-openings to the diameter of the respective through-opening is constant over the length of the cooling duct.

4. The arrangement as claimed in claim 3, wherein the ratio of the height between the plate-shaped element and the wall at one of the through-openings to the diameter of the respective through-opening is greater than 1.

5. The arrangement as claimed in claim 2, wherein the ratio of the distance between adjacent through-openings to the diameter of one of the through-openings is greater than 1.5.

6. The arrangement as claimed in claim 1, further comprising at least one additional inlet opening for the cooling medium into the cooling duct, by means of which inlet opening the cooling medium can enter in the flow direction of the cooling duct.

7. The arrangement as claimed in claim 1, wherein the through-openings are arranged in a plurality of rows which extend parallel to the flow direction.

8. The arrangement on the combustion chamber of a turbomachine, as claimed in claim 1, in which the height between the plate-shaped element and the wall increases from a turbine outlet end of the combustion chamber to an opposite end of the combustion chamber.

9. An arrangement for cooling a component, comprising:

at least one cooling duct configured between a wall to be cooled and a plate-shaped element for flow of a cooling medium in a flow direction along the wall to be cooled, the plate-shaped element being at a height from the wall and having a number of through-openings for impingement of flow of the cooling medium onto the wall, the height between the plate-shaped element and the wall increasing in the flow direction of the cooling medium flowing through the cooling duct, diameters of adjacent through-openings in the plate-shaped element increase with increasing height between the plate-shaped element and the wall, wherein a ratio of a distance between adjacent through-openings to the diameter of one of the adjacent through-openings is constant over the length of the cooling duct.

10. The arrangement as claimed in claim 9, wherein each of the diameters of the through-openings is proportional to a length measured in the flow direction from the beginning of the cooling duct to a respective position of the through-openings on the cooling duct.

11. The arrangement as claimed in claim 9, wherein a ratio of the height between the plate-shaped element and the wall at one of the through-openings to the diameter of the respective through-opening is constant over the length of the cooling duct.

12. The arrangement as claimed in claim 11, wherein the ratio of the height between the plate-shaped element and the wall at one of the through-openings to the diameter of the respective through-opening is greater than 1.

13. The arrangement as claimed in claim 9, wherein the ratio of the distance between adjacent through-openings to the diameter of one of the through-openings is greater than 1.5.

14. The arrangement on the combustion chamber of a turbomachine, as claimed in claim 9, in which the height between the plate-shaped element and the wall increases from a turbine outlet end of the combustion chamber to the an opposite end of the combustion chamber.

15. An arrangement for cooling a component, comprising:

at least one cooling duct configured between a wall to be cooled and a plate-shaped element for flow of a cooling medium in a flow direction along the wall to be cooled, the plate-shaped element being at a height from the wall and having a number of through-openings for impingement of flow of the cooling medium onto the wall, the height between the plate-shaped element and the wall increasing in the flow direction of the cooling medium flowing through the cooling duct, diameters of adjacent through-openings in the plate-shaped element increase with increasing height between the plate-shaped element and the wall, wherein a ratio of the height between the plate-shaped element and the wall at one of the through-openings to the diameter of the respective through-opening is constant over the length of the cooling duct.

16. The arrangement as claimed in claim 15, wherein the ratio of the height between the plate-shaped element and the wall at one of the through-openings to the diameter of the respective through-opening is greater than 1.

17. The arrangement on the combustion chamber of a turbomachine, as claimed in claim 15, in which the height between the plate-shaped element and the wall increases from a turbine outlet end of the combustion chamber to the an opposite end of the combustion chamber.

18. The arrangement as claimed in claim 15, wherein each of the diameters of the through-openings is proportional to a length measured in the flow direction from the beginning of the cooling duct to a respective position of the through-openings on the cooling duct.

19. The arrangement as claimed in claim 15, wherein a ratio of a distance between adjacent through-openings to the diameter of one of the adjacent through-openings is constant over the length of the cooling duct.

20. The arrangement as claimed in claim 19, wherein the ratio of the distance between adjacent through-openings to the diameter of one of the through-openings is greater than 1.5.

* * * * *